US009332794B2

(12) United States Patent
Mazzarolo et al.

(10) Patent No.: US 9,332,794 B2
(45) Date of Patent: May 10, 2016

(54) AIRBAG SYSTEM FOR MOTORCYCLE DRIVERS

(75) Inventors: Giovanni Mazzarolo, Coste di Maser (IT); Colin Ballantyne, Caselle d'Asolo (IT)

(73) Assignee: Alpinestars Research Srl, Coste di Maser (Treviso) (IT)

( * ) Notice: Subject to any disclaimer, the term of this patent is extended or adjusted under 35 U.S.C. 154(b) by 978 days.

(21) Appl. No.: 13/375,617

(22) PCT Filed: Jun. 5, 2009

(86) PCT No.: PCT/IT2009/000247

§ 371 (c)(1),
(2), (4) Date: Dec. 1, 2011

(87) PCT Pub. No.: WO2010/140176

PCT Pub. Date: Dec. 9, 2010

(65) Prior Publication Data

US 2012/0073035 A1 Mar. 29, 2012

(51) Int. Cl.
*A41D 13/018* (2006.01)
*A41D 13/05* (2006.01)

(52) U.S. Cl.
CPC ..... *A41D 13/0512* (2013.01); *A41D 13/018* (2013.01)

(58) Field of Classification Search
CPC ..... A41D 13/018; A41D 13/0512; A41D 13/015; A41D 13/00; A41D 13/05; A41D 13/0115; A41D 2600/102; A63B 71/12
USPC ..... 2/267, 268, 425, 459, 461, 463, 465, 2/456, 455, 467; 280/730.1
See application file for complete search history.

(56) References Cited

U.S. PATENT DOCUMENTS 3,422,458 A 1/1969 Schueller
3,930,667 A * 1/1976 Osuchowski ..... A41D 13/018 2/DIG. 3
4,059,852 A * 11/1977 Crane ..... A41D 13/018 2/456
4,089,065 A * 5/1978 McGee ..... A41D 13/018 2/2.14

(Continued)

FOREIGN PATENT DOCUMENTS

DE 2626765 12/1977
DE 3616890 A1 11/1987

(Continued)

OTHER PUBLICATIONS

"Polyimide, n." Dictionary.com. Web. Dec. 11, 2014.*

(Continued)

*Primary Examiner* — Robert J Hicks
*Assistant Examiner* — Jillian K Pierorazio
(74) *Attorney, Agent, or Firm* — Fredrikson & Byron, P.A.

(57) ABSTRACT

A garment which comprises an inflatable protective device able to expand from a rest condition, wherein it's in a deflated status, to a working condition, wherein it's in an inflated status, inflation means able to inflate said protective device and an electronic controller able to activate the inflation means if a risk and/or danger signal is detected by sensors incorporated in the garment. The inflatable protective device, after being moved to the working condition, can return automatically to the rest condition without requiring to be repacked or reset and the inflation means can inflate the protective device more than once without requiring to be recharged.

20 Claims, 4 Drawing Sheets

(56) References Cited

U.S. PATENT DOCUMENTS 4,397,046 A * 8/1983 Steiner ..... A41D 13/018 2/44
4,977,623 A * 12/1990 DeMarco ..... A41D 13/018 2/456
5,362,098 A * 11/1994 Guill ..... 280/733
5,500,952 A * 3/1996 Keyes ..... A41D 13/018 2/465
5,535,446 A 7/1996 Pusic
5,746,442 A * 5/1998 Hoyaukin ..... A41D 13/018 2/456
5,781,936 A 7/1998 Alaloof
5,867,842 A * 2/1999 Pinsley ..... A41D 13/018 2/462
5,937,443 A * 8/1999 Kageyama ..... A41D 13/018 2/455
6,012,162 A * 1/2000 Bullat ..... A41D 13/018 2/2.5
6,032,299 A * 3/2000 Welsh ..... A41D 13/018 2/456
6,125,478 A 10/2000 Alaloof
6,298,487 B1 * 10/2001 Mayhew ..... A41D 13/018 2/108
6,433,691 B1 * 8/2002 Hilliard ..... A41D 13/018 280/728.1
6,546,561 B2 * 4/2003 Duhamell ..... A41D 13/018 2/102
6,766,535 B2 * 7/2004 Duhamell ..... A41D 13/018 2/102
6,770,578 B2 8/2004 Veiga
6,951,493 B1 * 10/2005 Lu ..... B63C 9/08 2/DIG. 3
7,328,464 B2 * 2/2008 Lee ..... A41D 13/018 2/102
7,370,370 B2 * 5/2008 Colombo ..... A41D 13/018 2/69
7,543,846 B2 * 6/2009 Makabe ..... A41D 13/018 280/730.1
7,707,658 B2 * 5/2010 Culhane ..... 2/227
7,921,472 B2 * 4/2011 Mazzarolo ..... A41D 13/018 2/108
8,365,316 B2 * 2/2013 Jan ..... A41D 13/018 2/102
8,595,864 B2 * 12/2013 Orita ..... A41D 13/018 2/102
2001/0049840 A1 * 12/2001 Atanasio ..... A41D 13/018 2/456
2002/0013107 A1 * 1/2002 Angelini ..... B63C 11/30 441/88
2002/0078484 A1 6/2002 Ulert et al.
2002/0140218 A1 10/2002 Beasley
2005/0067816 A1 * 3/2005 Buckman ..... 280/730.1
2006/0107952 A1 * 5/2006 Schlosser ..... A41D 13/018 128/202.19
2006/0124376 A1 * 6/2006 Goto ..... B62J 27/00 180/271
2006/0125206 A1 * 6/2006 Goto ..... A41D 13/018 280/290
2006/0175810 A1 8/2006 Goto
2006/0248632 A1 11/2006 Colombo
2008/0010729 A1 * 1/2008 Delara ..... A41D 13/018 2/455
2008/0178370 A1 * 7/2008 Orita ..... A41D 13/018 2/455
2008/0313794 A1 * 12/2008 Schuller ..... A41D 13/0155 2/463
2009/0055053 A1 * 2/2009 Carmeli ..... B60R 21/0132 701/45
2009/0127835 A1 * 5/2009 Lin ..... B60R 21/0132 280/730.1
2012/0011642 A1 * 1/2012 Dainese ..... A41D 13/018 2/455
2012/0023648 A1 * 2/2012 Dainese ..... A41D 13/018 2/456

FOREIGN PATENT DOCUMENTS

DE 19640658 A1 4/1998
EP 0051254 5/1982
EP 0743021 A2 11/1996
EP 1315427 12/2005
EP 1668999 A1 6/2006
EP 1749705 2/2007
FR 2674761 10/1992
FR 2677856 A1 12/1992
FR 2822028 9/2002
GB 2352162 A 1/2001
WO 0069292 A1 11/2000
WO 2005094620 A1 10/2005
WO 2006000248 1/2006
WO 2006009970 1/2006
WO 2007022147 2/2007
WO 2008044222 A2 4/2008
WO 2009047733 4/2009
WO 2010067289 6/2010

OTHER PUBLICATIONS

Protection. Merriam-Webster Dictionary. Web Jun. 25, 2015. http://www.merriam-webster.com/dictionary/protection.*
Notice of Opposition filed by Applicant Alpinestars S.p.A. dated Apr. 4, 2013 against European Patent. No. 2373189, 23 pages.
Notice of Opposition filed by Applicant Alpinestars S.p.A. dated Nov. 7, 2012 against European Patent No. 2373188, 33 pages.
Official Action issued Feb. 13, 2013 by the Examining Division of the EPO for European Application S.N. 09787748.4, 2 pages.
Observations filed by third parties before the EPO during the examination procedure of the corresponding European Patent Application No. 09787748.4, Jan. 16, 2013, 9 pages.
Logbook for Side Curtain Airbag Mounted on a Volkswagen Touran, Nov. 24, 2006.
"PCT International Search Report dated Feb. 18, 2010 for PCT/IT2009/000247, from which the instant application is based," 3 pgs.
"PCT International Preliminary Report on Patentability dated Mar. 29, 2011 for PCT/IT2009/000247, from which the instant application is based," 6 pgs.
Notice of Opposition, dated Sep. 18, 2014 and filed by Dianese SpA against European Pat. No. 2437627, 23 pages.

* cited by examiner

AIRBAG SYSTEM FOR MOTORCYCLE DRIVERS

RELATED APPLICATIONS

This application is a 35 U.S.C. 371 national stage filing from, and claims priority to, International Application No. PCT/IT2009/000247 filed Jun. 5, 2009, the teachings of which are incorporated herein by reference.

FIELD OF THE INVENTION

The present invention relates to a garment which, in addition to protecting a user's body from the normal climatic conditions (wind, rain, etc.) is also associated with an inflatable protective device.

BACKGROUND

Motorcycling has always been identified as a sport which carries additional risks due to the high speed and to the limited protection that clothing can provide if the rider is involved in an accident. For many years designers of motorcycle clothing have tried to balance the need of providing an adequate protection against a severe impact, which normally requires several layers of stiff padding, with the requirement of wearing a piece of clothing which is as lighter and as supple as possible.

Articles of clothing equipped or associated with inflatable protectors (commonly referred to as "airbags") have thus been conceived. When the protection is not required the deflated chamber is thin and flexible, but in the event of an accident the chamber is inflated and thus energy from severe impacts can be absorbed. DE 3616890, U.S. Pat. No. 5,535,446, WO0069292 and EP 1668999 illustrate some examples of inflatable systems which have been proposed over the years.

These systems have mainly been envisaged for use in the road traffic environment and are typically inflated when the motorcycle impacts against another object.

The above systems may be acceptable for the road environment, but in the motorcycle racing environment, where crashes are more frequent, these systems are less effective owing to the following drawbacks:

- the accident is not normally caused by the motorcycle impacting an obstacle;
- the inflatable chambers are substantially large, and these carry a weight penalty due to the increased amount of fabric and larger gas cylinder;
- after an accident, if it's possible, the rider normally attempts to continue riding, however in these systems, once deployed, the inflatable chambers remain exposed and can flap around the garment and this will hinder the rider.

A solution to the above mentioned drawbacks is proposed by WO 2008/044222 that describes an air bag system specifically designed for racing use. The inflatable chamber of said system is smaller and after the deployment the rider can remove the spent chamber from the protective garment and continue riding. Even if this system is an improvement over the prior art, it cannot be considered as the best solution, because it does not solve the following drawbacks:

- the inflatable chamber is still quite large such that the airbag must be folded to fit in the suit and emerge outside the suit when inflated;
- the rider still has to perform an action to detach the deployed chamber and, under the pressure of the race going on, there is a strong chance that the rider will not execute this procedure correctly;
- if the rider continues racing, in case of another crash, he will not have protection because the system has been removed and the inflation means only have sufficient gas capacity for a single inflation.

BRIEF SUMMARY OF EMBODIMENTS OF THE INVENTION

The object of the invention is to provide a garment equipped with an inflatable protective device which solves the above mentioned problems and drawbacks.

In particular, a main object of the present invention is to provide a garment equipped with an inflatable protective device that does not require to be changed, repacked or reset after having been activated in case of accident.

Another object of the present invention is to provide a garment equipped with an inflatable protective device suitable to assure to the rider, even after an accident, exactly the same level of the protection without hindering the rider during the race.

At last, another object of the present invention is to provide a garment equipped with an inflatable protective device which after the activation in consequence, of an accident or an impact, can autonomously and automatically return to a rest configuration, without needing any action from the user.

These and other objects are achieved by the garment according to claim 1.

BRIEF DESCRIPTIONS OF DRAWINGS

The advantages and the characteristic features of the invention will be appreciated more clearly from the following description of a preferred, but not exclusive, embodiment of the garment with reference to the accompanying figures in which.

DETAILED DESCRIPTION OF EMBODIMENTS OF THE INVENTION

Figure 1:
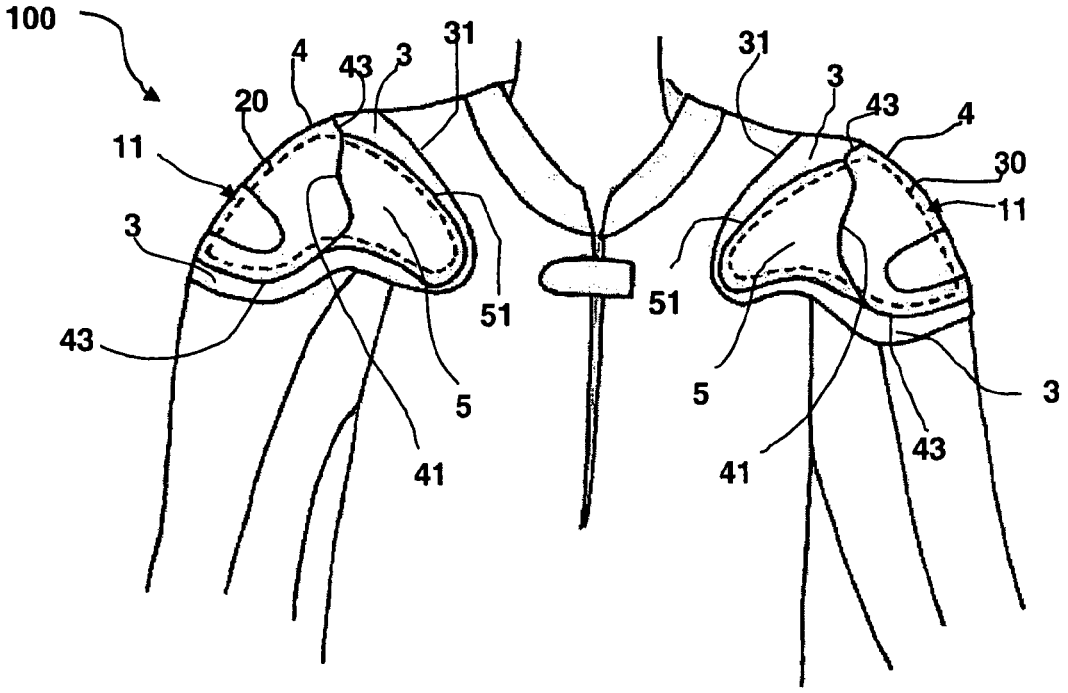
FIG. 1 shows a schematic front view of the garment according to the invention wherein the inflatable protective device is in the deflated configuration.
Figure 2:
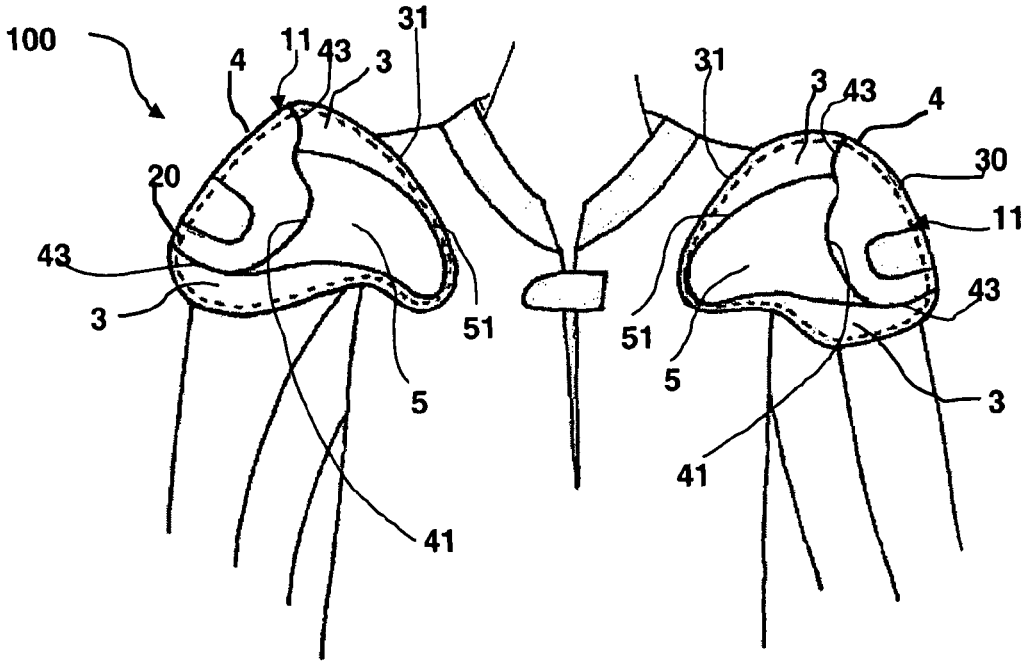
FIG. 2 shows a schematic front view like FIG. 1 wherein the inflatable protective device is in the inflated configuration.
Figure 3:
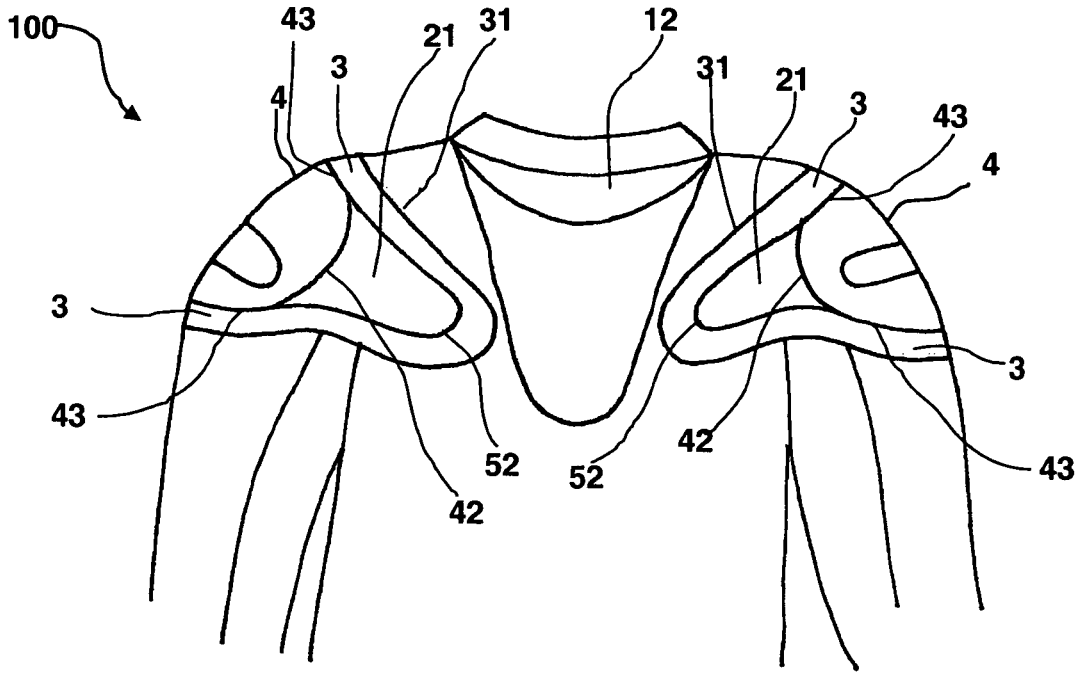
FIG. 3 shows a schematic rear view of the garment according to the invention.

With reference to the enclosed figures, the present invention relates to a garment 100 comprising an inflatable protective device 11 able to move from a rest condition, wherein it's in a deflated status, to a working condition, wherein it's in an inflated status, an inflation means 10 able to inflate said protective device 11 and an electronic controller 9 able to activate the inflation means 10 if a risk and/or danger signal is detected by sensors incorporated in the garment 100. The inflatable protective device 11, after having taken the working or inflated condition, is autonomously and automatically returned to the rest condition without requiring to be repacked or reset and the inflation means 10 can inflate the protective device 11 more than once without requiring to be recharged.

The protective device 11 is made from a single sheet of elastic material such as polyurethane which allows the protective device 11 a greater material expansion compared with the air bags materials usually adopted. As a matter of fact, materials usually used in the airbags construction like polythene, nylon 6 and nylon 6,6, are woven into fabrics. This provides adequate abrasion resistance but very little stretch.

The potential drawback of less resistance of the elastic material against abrasion is overcome because the protective device 11 is designed to be never exposed to the external environment and thus never come into contact with an obstacle or with the road surface directly. The protective device 11 when it is in the working condition, it does not emerge outside the garment 100 but it remains inside a pocket 7 formed between a protection element 4, fixed to the external layer 14 of the garment 100, and the external layer 14 of the garment 100. The size of the protecting device 11 is relatively small and it's positioned flat inside the pocket 7 without needing to be packed or folded. As a matter of fact, as before mentioned, due to its elastic properties, it's able all the same to reach a volume which guarantees the same level of protection offered by the known airbags.

The protection element 4 is fixed to the garment 100 by means of an elastic border 3 which, owing its elastic properties, is able to be stretched for allowing the accommodation inside the garment 100 of the protective device 11 also when the latter is moved from the rest condition to the working condition, increasing its volume.

In a preferred embodiment of the present invention, said inflatable protective device 11 comprises two inflatable chambers 20, 30 of bag-like shape; a first inflatable chamber 20 being positioned on the right shoulder and a second inflatable chamber 30 being positioned on the left shoulder.

In another embodiment (not shown) the inflatable protective device 11 comprises more than two inflatable chambers 20, 30 which protect shoulders and/or other body parts like for example neck, chest, back, arms and/or legs.

In the preferred embodiment the inflatable chambers 20, 30 are fastened on the outer surface 14 of the garment 100 and underneath a shoulder cup 4.

Figure 5:
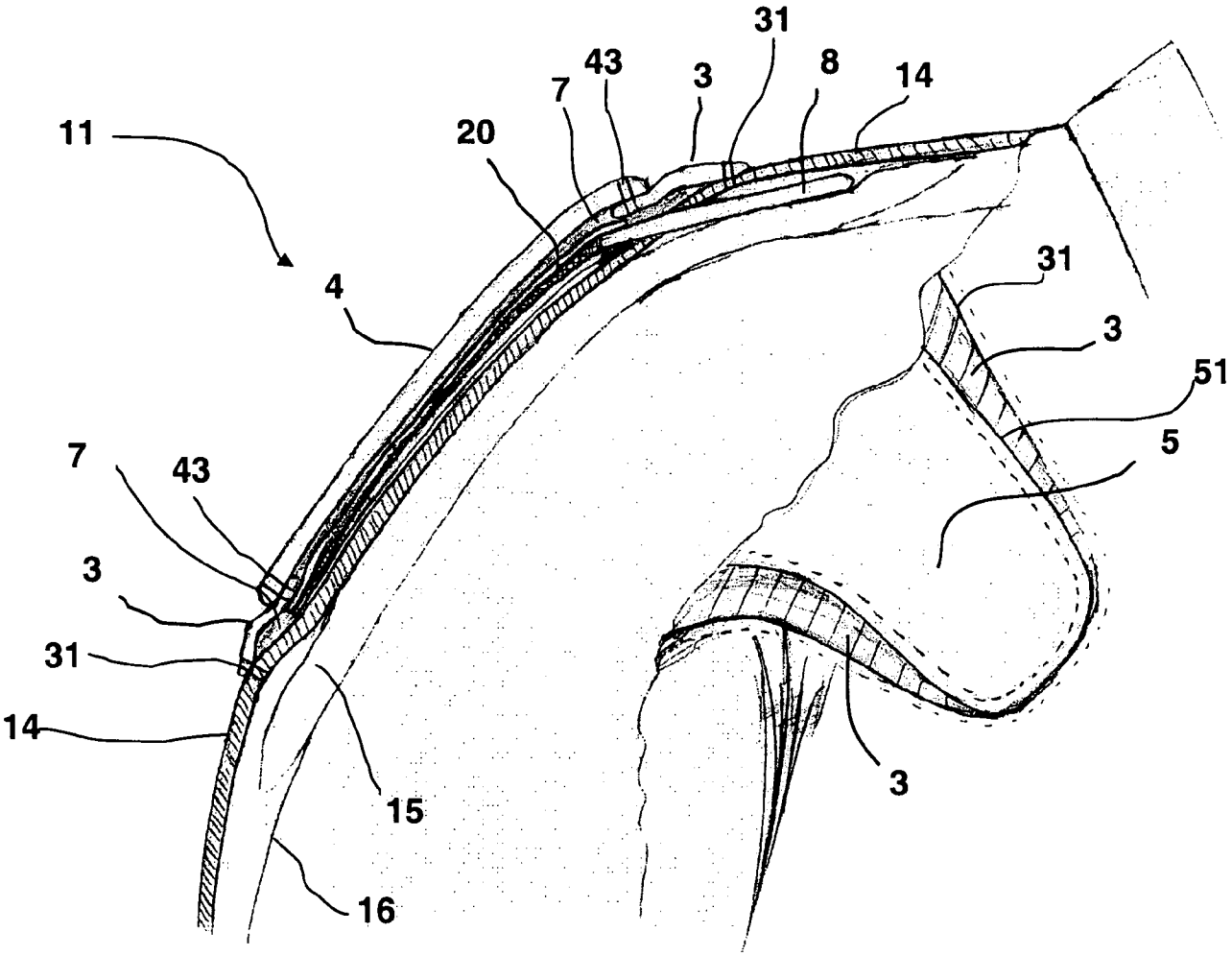
FIG. 5 shows a front cross sectional view of the inflatable protective device associated to the garment in the deflated configuration.
Figure 6:
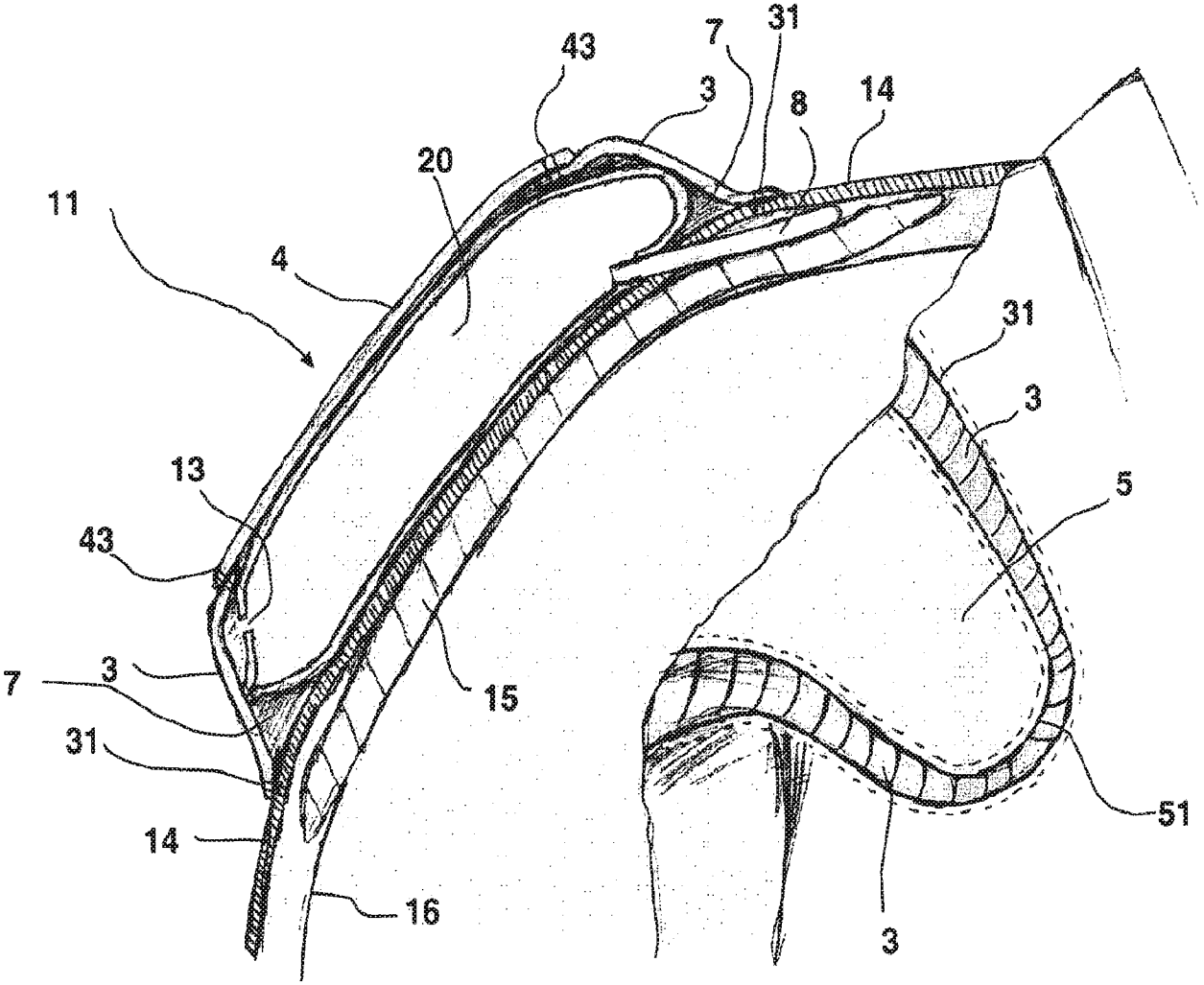
FIG. 6 shows a front cross sectional view of the inflatable protective device associated to the garment in the inflated configuration.

The size of each chamber 20, 30 is usually less than 10 liters. In this way each chamber 20, 30 can be inserted into the garment 100 without having to fold it or pack it in a particular manner. As shown in FIGS. 5 and 6, the chambers 20, 30 can lie flat directly onto the surface to be protected. The chambers 20, 30 advantageously take up very little thickness on the garment 100 being positioned between only two material layers (shoulder cup 4 and outer surface 14 of the garment 100). As consequence the weight penalty for the system is almost negligible due to reduced amount of fabric and this means that riders are not discouraged from using this device because of the weight.

As shown in FIGS. 5 and 6, part of the chambers 20, 30 is covered by the shoulder cup 4, while the portion outside is covered by two secondary flaps 5 and 21. The first flap 5 extends from the shoulder towards the user's chest and the second flap 21 extends rearwards from the shoulder towards the user's shoulder blade. Said flaps 5, 21 normally are made of leather or similar materials.

A first portion 41, 42 of the external perimeter of the shoulder cup 4 is attached to the flaps 5, 21 and a second portion 43 of the external perimeter of the shoulder cup 4 is attached to an elastic border 3. The portion 51, 52 of the perimeter of flaps 5, 21 not attached to the shoulder cup 4 is connected to the elastic border 3. In this way, it should be noted, that the assembly shoulder cup-flaps is not directly attached to the garment 100 but to the elastic border 3 which is in turn connected, around its external perimeter 31, to the garment 100. Said attachments can made by means of a stitching or by other fastening means like Velcro®, zip or stud fasteners.

In all cases, shoulder cups 4, flaps 5, 21 and elastic border 3 are attached to the garment 100 so as to prevent the rupture of the garment 100 and the erupting from the garment 100 of the inflatable protecting device 11.

Both in the rest condition and in the working condition, the chambers 20, 30 remain inside the pocket created by the shoulder cup 4, elastic border 3 and additional flaps 5 and 21.

The inflation means 10 are able to inflate the protective device 11 and are usually positioned in the garment aerodynamic hump 12, placed on the back of the rider.

Such means can comprise a gas generator or a cylinder of gas compressed or other known means. In all cases, the inflation means 10 contain more than one inflation charge and, as will be illustrated in detail, in this way the inflation means 10 are able to inflate the protective device 11 more than once.

The inflation means 10 can be activated by an electronic controller 9 of known type which has the function to activate the inflation means 10 if a risk and/or danger signal is detected by sensors which are incorporated in the garment 100. After having received an activation signal from the electronic controller 9, the inflation means 10 are able to feed gas to protective device 11 by means of connecting means 8. In this way the protective device 11 can change its shape from the rest condition, wherein it's in a deflated status, to the working condition, wherein it's in an inflated status. The external surface of the protective device 11 is provided with an escape vent 13 for the controlled escape of the inflating air from the inflatable protective device 11. Said escape vent 13 has dimensions such as not to hinder the inflation of the protective device 11 and consequently the impact protection offered by the garment 100. The gas fed in the protective device 11 by means of the connecting means 8 is allowed to outwardly through the escape vent 13. In this way the protective device 11, after being moved in the working condition, in case of accident, can be slowly deflated and then return to the rest condition.

Figure 4:
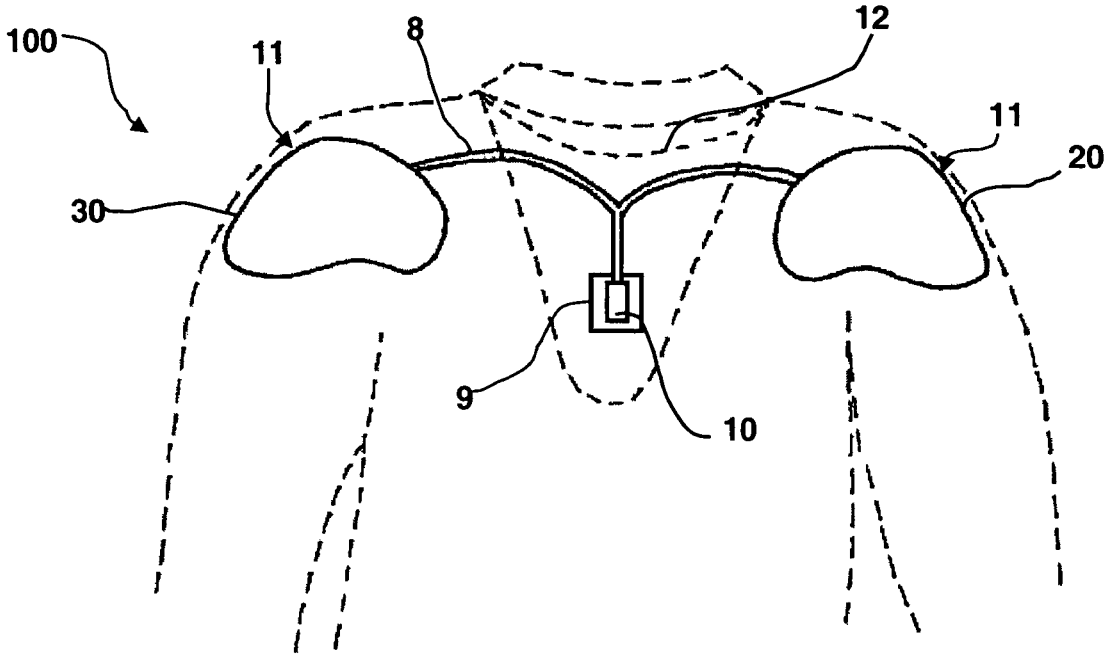
FIG. 4 shows a schematic rear view of the connection between the inflatable protective device and the actuation means thereof.

In a preferred embodiment, as shown in FIG. 4, the two chambers 20, 30 can receive the gas fed by the inflation means 10 by means of a Y shaped tube 8 which runs between the garment lining 16 and the outer layer 14.

As shown in FIGS. 5 and 6, underneath of each chamber 20, 30 a shoulder armour 15 with corresponding padding means is positioned.

Hereinafter the operation of the protective device 11 will be described in detail with reference to the preferred embodiment.

During the normal use, for example during a race, each chamber 20, 30 is in rest deflated condition, while the electronic controller 9 carries out a continuous monitoring of the sensor inputs for detecting when and if a danger situation arises for the user.

In case of fall, the electronic controller 9 provides to the gas generator 10 an activation signal. The gas generator 10 then feeds gas to each chamber 20, 30 to expand these from the rest condition to the working condition thus reaching its maximum volume.

The elastic border 3 is stretched for accommodating the increased volume of each chamber 20, 30 under the assembly shoulder cup-flaps, while the shape and rigidity of the shoulder cup 4 help form and strengthen the inflated chamber 20, 30 beneath.

The inflation of each chamber 20, 30 is instantaneous and in this way a proper protection to the user is certainly provided. As above mentioned, the escape vent 13 does not compromise the inflation of the chambers 20, 30 since its dimensions are too small to allow a fast discharge outwardly of air from the inflated chambers 20, 30.

The escape vent 13, as a matter of fact, is designed to enable a slow discharge of each chamber 20, 30 so as they can deflate from the working condition to the initial rest condition in around 60 seconds.

The deflation of each chamber 20, 30 is allowed not only by the escape vent 13 but also it's facilitated by the elastic border 3. Due to its elastic properties, the border 3 after being stretched owing the increase of the volume of each chamber 20, 30, is forced to return to its original non-tense configuration. Consequently the shoulder cup 4 exercises a compression on the chambers 20, 30 assisting the expulsion of the gas.

Upon the chambers 20, 30 are returned to their rest condition, the aerodynamics of the garment 100 is restored and thus, if the fall has not produced any particular damage, the rider can continue his race without being requested for repacking or jettison of the protective device 11 after its deployment.

As above mentioned, the gas generator 10 contains more than one inflation charge.

After that the chambers 20, 30 are deflated, the electronic controller 9 continues to monitor the sensor inputs and if required can activate the gas generator 10 again, until the amount of charges in the gas generator 10 is exhausted. In this way, the garment 100 can provide to the user the same level of protection to what was experienced beforehand.

From the above description it is clear that the garment of the present invention has characteristics such as to solve advantageously the problems and drawbacks of the devices set out in the prior art.

The present invention has been described with reference to a preferred embodiment, but mechanically equivalent solutions are foreseeable falling within the scope of the following claims.

The invention claimed is:

1. A garment comprising: at least one inflatable protective device able to move from a rest condition, wherein the device is in a deflated status, to a working condition, wherein the device is in an inflated status; an inflation means able to inflate said device, the inflation means containing more than one inflation charge; an electronic controller configured to activate the inflation means via activation signal delivered by the controller; and means for controlling escape of inflating air from the device, whereby said device is able to steadily move from the working condition to the rest condition such that movement of said device from the rest condition to the working condition is later repeatable due to said more than one inflation charge; wherein said device, whether in the rest condition or working condition, remains inside a pocket formed between a protection element and an external layer of the garment, the protection element being positioned over the external layer of the garment, wherein the protection element moves outward as a whole relative to the external layer of the garment when the device is moved to the working condition, and wherein the protection element is joined to the garment by means of an elastic border, the elastic border attached to at least a portion of the protection element and able to be stretched for allowing accommodation of the device inside the pocket when the device is moved from the rest condition despite the device increasing in volume.

2. The garment of claim 1, wherein the protection element is in a shape of a cup.

3. The garment of claim 1, wherein the device is made from a single sheet of elastic material.

4. The garment of claim 3, wherein the elastic material is polyurethane.

5. The garment of claim 1, wherein the device when moved from said working condition to said rest condition resumes a flattened state inside the pocket without needing to be packed or folded.

6. The garment of claim 1, wherein the device comprises two inflatable chambers each in a shape of a bag; a first inflatable chamber being positioned on a right shoulder of the garment and a second inflatable chamber being positioned on a left shoulder of the garment.

7. The garment of claim 6, wherein the two chambers are adapted to receive gas from the inflation means by tubing.

8. The garment of claim 7, wherein the tubing comprises a Y-shaped tube.

9. The garment of claim 6, wherein the two chambers remain inside corresponding pockets, each corresponding pocket created by corresponding of the protection element and the elastic border, and additional flaps.

10. The garment of claim 9, wherein the two chambers are adapted to receive gas from the inflation means by tubing.

11. The garment of claim 10, wherein the tubing comprises a Y-shaped tube.

12. The garment of claim 1, wherein the device comprises two inflatable chambers configured for protecting a user's shoulders.

13. The garment of claim 12, wherein the two chambers remain inside corresponding pockets, each corresponding pocket created by corresponding of the protection element and the elastic border, and additional flaps.

14. The garment of claim 1, wherein the device comprises more than two inflatable chambers configured for protecting one or more of a user's shoulders, neck, chest, back, arms, and legs.

15. The garment of claim 14, wherein the more than two inflatable chambers remain inside corresponding pockets, each corresponding pocket created by corresponding of the protection element and the elastic border, and additional flaps.

16. The garment of claim 1, wherein each activation signal is prompted via sensing from the garment.

17. The garment of claim 1, wherein activation of the inflation means dictates use of one of the more than one inflation charge.

18. The garment of claim 1, wherein the movement of the device from the working condition to the rest condition is automatic.

19. The garment of claim 1, wherein the protection element moves inward as a whole relative to the external layer of the garment when the device is moved to the rest condition.

20. The garment of claim 1, wherein the protection element is made of rigid material in order to outwardly form and strengthen, as well as inwardly protect, the device under the element.

* * * * *